US005087942A

United States Patent [19]

Rushing

[11] Patent Number: 5,087,942

[45] Date of Patent: Feb. 11, 1992

[54] AUTOMATIC SET-UP FOR ELECTROPHOTOGRAPHIC COPYING OF TRANSPARENCY ORIGINALS

[75] Inventor: Allen J. Rushing, Webster, N.Y.

[73] Assignee: Eastman Kodak Company, Rochester, N.Y.

[21] Appl. No.: 706,485

[22] Filed: May 28, 1991

[51] Int. Cl.[5] ..... G03G 21/00

[52] U.S. Cl. ..... 355/214; 355/229; 355/246

[58] Field of Search ..... 355/208, 214, 228, 229, 355/245, 246, 69, 244, 326, 327

[56] References Cited

U.S. PATENT DOCUMENTS

| | | | |
|---|---|---|---|
| 3,645,620 | 2/1972 | Jaffe | 355/69 |
| 4,027,962 | 6/1977 | Mailloux | 355/244 |
| 4,043,656 | 8/1977 | Cherian | 355/244 X |
| 4,063,810 | 12/1977 | Mailloux | 355/327 |
| 4,068,939 | 1/1978 | Mailloux | 355/326 |
| 4,111,542 | 9/1978 | Mailloux et al. | 355/308 |
| 4,120,580 | 10/1978 | Mailloux et al. | 355/327 |
| 4,239,374 | 12/1980 | Tatsumi et al. | 355/214 |
| 4,702,593 | 10/1987 | Detsch | 355/228 |
| 4,829,336 | 5/1989 | Champion et al. | 355/246 |
| 4,894,685 | 1/1990 | Shoji | 355/246 |
| 4,990,957 | 2/1991 | Nakanishi et al. | 355/228 |

*Primary Examiner*—A. T. Grimley
*Assistant Examiner*—Sandra L. Brase
*Attorney, Agent, or Firm*—Milton S. Sales

[57] ABSTRACT

An electrophotographic copier uses a first light source to copy reflection originals and uses a second light source to copy transparency originals. Operation of the copier is adjusted to attain a desirable copy image of reflection originals using the first light source, and then the second light source is used to expose a patch on the image receiver through a test transparency of predetermined optical density. When the patch is developed, its optical density is compared to an aim value, and any difference is used for adjusting the exposure value of the second light source.

4 Claims, 2 Drawing Sheets

AUTOMATIC SET-UP FOR ELECTROPHOTOGRAPHIC COPYING OF TRANSPARENCY ORIGINALS

CROSS REFERENCE TO RELATED APPLICATIONS

Reference is made to commonly assigned, copending U.S. patent application Ser. No. 07/678,396 entitled AUTOMATIC SET-UP IN ELECTROSTATOGRAPHIC MACHINES and filed on Apr. 1, 1991, in the names of A. Rushing and B. McLean.

BACKGROUND OF THE INVENTION

1. Field of the Invention

The invention relates to electrophotographic document copiers adapted to reproduce transparency originals, and more particularly to automatic adjustment of parameters influencing the output reproduction of such copiers.

2. Description of the Prior Art

In electrophotographic copiers, image contrast, density, and color balance (in color machines) can be adjusted by changing certain process control parameters such as primary voltage $V_O$, exposure $E_O$, development station electrode bias voltage $V_b$, the concentration of toner in the developer mixture, and the image transfer potential.

Control of such parameters is often based on measurements of the density of a toner image in a test patch. U.S. Pat. No. 4,894,685, issued Jan. 16, 1990, discloses a method for setting color process control parameters by forming a plurality of different density test patches in a non-transfer portion of a photoconductor. Process control parameters are set in accordance with the differences between the recorded densities and aim densities. However well this and similar set-up systems work for reflection originals, they are generally inferior when used to set the process control when copying transparencies, such as 35 mm color slides, to produce pictorial quality color opaque copies.

It has been found that the illumination system used to copy opaque originals placed on a platen does not produce sufficient intensity for copying transparencies because light rays from below the platen must pass through the transparency, be reflected from the platen cover, and pass back through the transparency onto the photoconductive surface.

To overcome the need for additional illumination, the prior art has provided a separate light source which is used to project an image from the transparency onto the platen. See for example U.S. Pat. No. 4,027,962, which issued to L. Mailloux on June 7, 1977. However, copiers that have had their process control parameters adjusted for best results when copying reflection originals with one light source may not be optimized for copying transparencies using a different light source. Also, the two light sources may age at different rates, causing very different changes in intensity and color characteristics.

DISCLOSURE OF INVENTION

It is an object of the present invention to provide for accurately determining process control adjustments for copying transparency originals.

According to a feature of the present invention, an electrophotographic copier that is adapted to use a first light source to copy reflection originals and to use a second light source to copy transparency originals, includes a photoconductive image receiver, calibration means for adjusting operation of the copier to attain a desirable copy image of reflection originals using the first light source, means associated with the second light source for exposing a patch on the image receiver through a test transparency of predetermined optical density, development means for toning the exposed patch to record a set-up toner density patch, means for detecting the density of the recorded set-up toner density patch, and means for adjusting the exposure value of the second light source in accordance with differences between the density of the recorded patch and a corresponding aim value.

According to another feature of the present invention, the copier includes means for generating a toner density aim value corresponding to the adjusted operation of the copier attained by the calibration means; and the means for adjusting the exposure value of the second light source operates in accordance with differences between the density of the recorded patch and the toner density aim value.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made the accompanying drawings, in which.

BEST MODE FOR CARRYING OUT THE INVENTION

For a detailed explanation of the theory of copier contrast and exposure control by changing various process control parameters, reference may be made to the following article: Paxton, Electrophotographic Systems Solid Area Response Model, 22 Photographic Science and Engineering 150 (May/June 1978).

Figure 1:
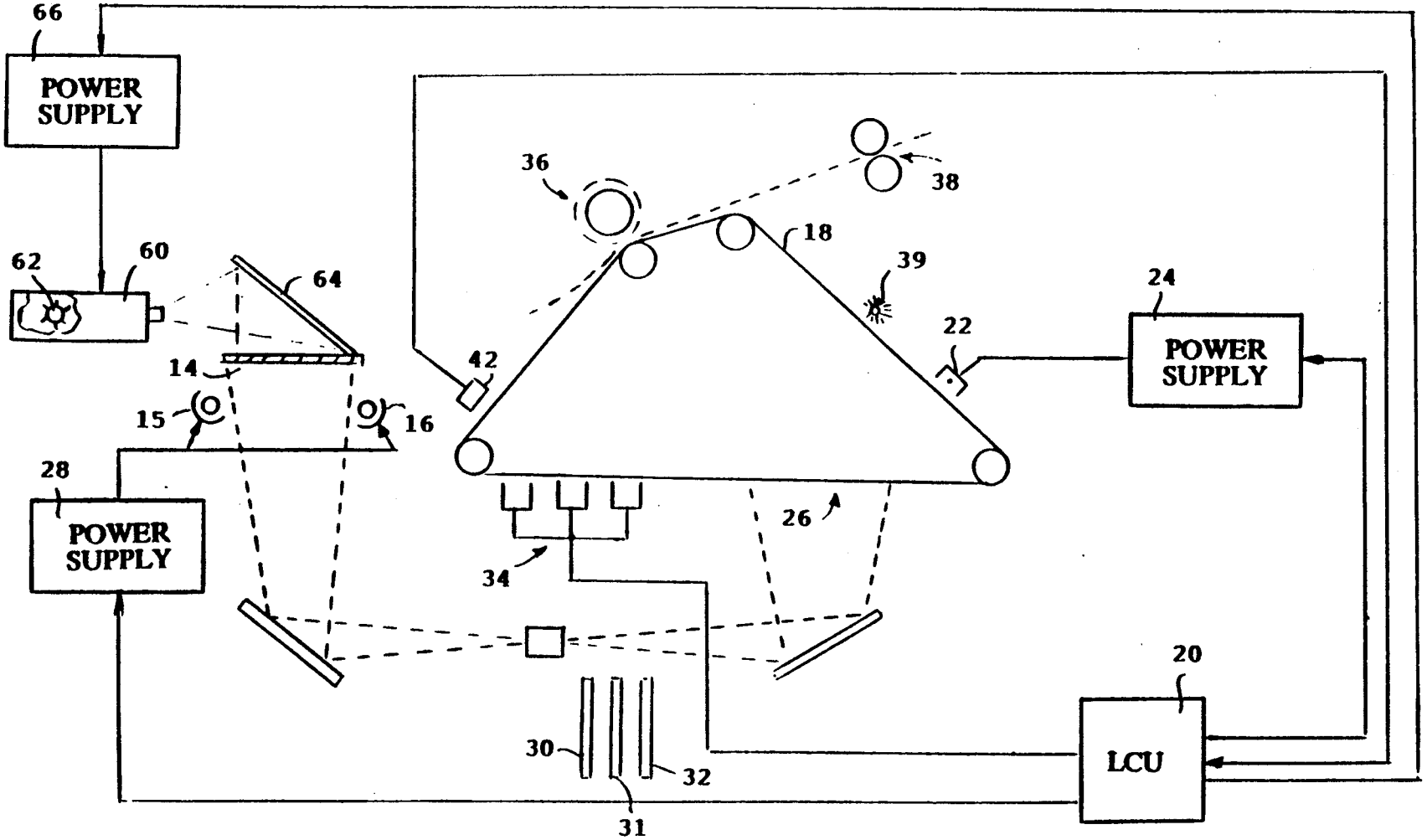
FIG. 1 is a schematic showing a side elevational view of an electrostatographic machine in which the invention is useful.

Referring to FIG. 1, a three-color copier includes an exposure platen 14 and xenon flashlamps 15 and 16. An image of the illuminated reflection original is optically projected onto one of a plurality of sequentially spaced, non-overlapping image frame areas of a moving image receiver such as photoconductive belt 18.

Photoconductive belt 18 is driven past a series of work stations of the copier. A microprocessor within a logic and control unit 20 has a stored program for sequentially actuating the work stations. For a complete description of the work stations, see commonly assigned U.S. Pat. No. 3,914,046. Briefly, a charging station 22 applies an electrostatic charge of predetermined initial voltage to the surface of the belt as controlled by a programmable power supply 24, which is in turn controlled by LCU 20.

The inverse image of the original is projected onto the charged surface of photoconductive belt 18 at an exposure station 26. The image dissipates the electrostatic charge and forms a latent charge image. A programmable power supply 28, under the supervision of LCU 20, controls the intensity and/or duration of light produced by lamps 15 and 16. This, of course, adjusts the exposure of belt 18, and thereby the voltage of the photoconductor just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 30, a green filter 31, or a blue filter 32 is inserted into the light path to form color separation latent charge images at exposure station 26. As understood in the art, provision may be made for a fourth exposure for areas to be developed in black, if desired.

Travel of belt 18 brings the areas bearing the latent charge images into a magnetic brush development area 34. Magnetic brush development stations are well known; for example, see U.S. Pat. No. 4,473,029 to Fritz et al and U.S. Pat. No. 4,546,060 to Miskinis et al. Conductive portions of the development station act as electrodes, and are electrically connected to a variable supply of D.C. potential controlled by LCU 20 for adjusting the development electrode bias voltage.

The copier also includes a transfer station 36 and a cleaning station 38, both fully described in commonly assigned U.S. patent application Ser. No. 809,546, filed Dec. 16, 1985. After transfer of the unfixed toner images to a copy sheet, such sheet is transported to a fuser station 40 where the image is fixed to the sheet.

A densitometer 42 is provided to monitor development of test patches at predetermined positions of photoconductive belt 18. The densitometer may consist of an infrared light emitting diode (LED) which shines through the belt (transmittance) or is reflected by the belt (reflectance) onto a photodiode. The photodiode generates a voltage proportional to the amount of light transmitted or reflected from a toned patch.

Figure 2:
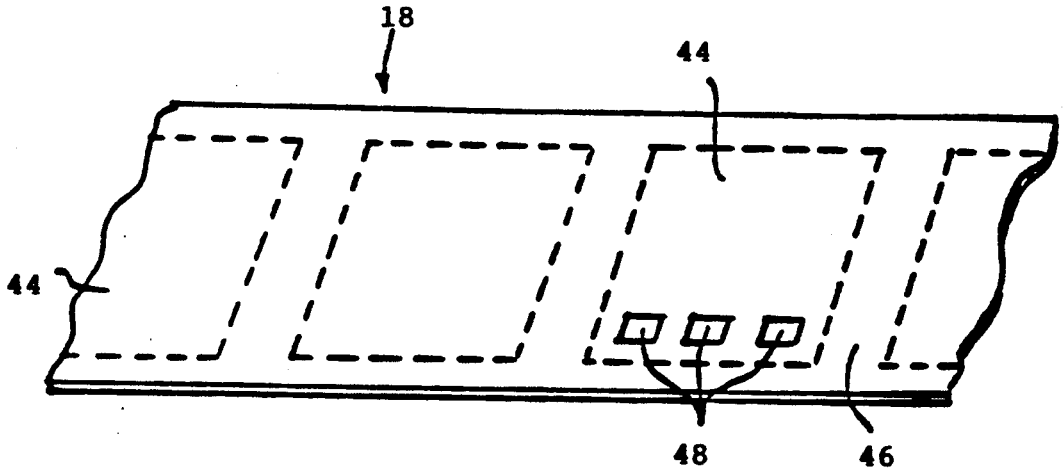
FIG. 2 is and enlarged fragmentary view of a portion of the image receiver of the machine shown in FIG. 1.

Referring to FIG. 2, a fragmentary view of a portion of photoconductive belt 18 is illustrated with a plurality of image frame areas 44 spaced slightly apart from each other along the longitudinal length of the belt; thus defining non-image interframe regions 46. In order to control the electrographic process, it is known to provide one or more toned reference patches 48 in either interframe regions 46, in frame areas 44 as illustrated, or in the cross-track margin region laterally outside of the image frame areas. By way of example, three toned reference patches 48 are shown. When multiple reference patches are used for density measurement, the patches preferably are exposed to obtain different density levels of toner so that the electrographic process can be checked and controlled for various operating parameters.

As toned reference patches 48 pass densitometer 42 (FIG. 1), a signal generated by the densitometer is provided to LCU 20, which is programmed to provide various feedback signals to portions of the apparatus in response to the signal received from the densitometer. For example, the control signal from the densitometer can cause the LCU to regulate a number of process control parameters that effects the density of the toner images on the photoconductive belt.

The copier may be configured to compare density readings to target values set during manufacture to maintain process control parameters, or it may compare the density readings to target values determined in a special "set-up" operation as fully described in commonly assigned, copending U.S. patent application Ser. No. 07/678,396 entitled AUTOMATIC SET-UP IN ELECTROSTATOGRAPHIC MACHINES and filed on Apr. 1, 1991, in the names of A. Rushing and B. McLean; the disclosure of which is incorporated herein by reference.

Referring back to FIG. 1, a color light image of a color transparency or a 35 mm slide, may be projected by a slide projector 60 onto a mirror 64. The mirror reflects the enlarged image onto platen 14. The slide projector includes a light source 62 adapted to illuminate the transparency. A suitable type of slide projector is sold under the trade name Carousel, manufactured by the Eastman Kodak Company of Rochester, N.Y.

A programmable power supply 66, under the supervision of LCU 20, controls the intensity and/or duration of light produced by light source 62. This, of course, adjusts the exposure of belt 18, and thereby the voltage of the photoconductor just after exposure.

Figure 3:
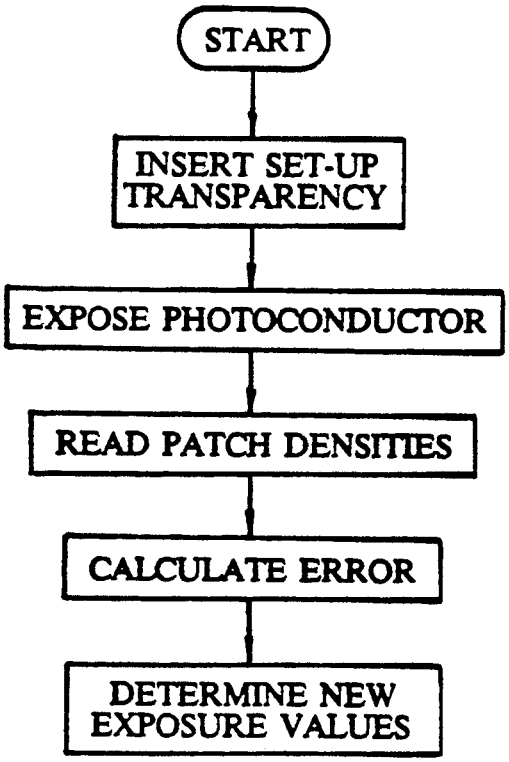
FIG. 3 is a logic flow chart of the operation of the set-up procedure according to the present invention.

According to the present invention, programmable power supply 66 may be adjusted from time to time by means of a transparency set-up procedure. Referring to FIG. 3, the transparency set-up procedure is initiated by operator placement of a special transparency or slide into projector 60 and exposing three successive image frame areas 44 of belt 18; using a different color filter 30, 31, and 32 for each exposure.

The special transparency has a gray scale pattern so as, when the illumination from light source 62 is correct, to produce toned reference patches which correspond in density levels to the reference patches produced for purposes of process control parameter adjustment.

As the toned reference patches by exposure through the special transparency pass densitometer 42 (FIG. 1), a signal generated by the densitometer is provided to LCU 20, which is programmed to provide various feedback signals to programmable power supply 66 in response to the differences between the density level signals received from the densitometer and aim density values. The illumination of light source 62 is adjusted according to the feedback signals to enhance exposure and color balance.

The invention has been described in detail with particular reference to preferred embodiments thereof, but it will be understood that variations and modifications can be effected within the spirit and scope of the invention.

What is claimed is:

1. An electrophotographic copier adapted to use a first light source to copy reflection originals and to use a second light source to copy transparency originals; said copier comprising:

a photoconductive image receiver;

calibration means for adjusting operation of the copier to attain a desirable copy image of reflection originals using the first light source;

means associated with said second light source for exposing a patch on the image receiver through a test transparency of predetermined optical density;

development means for toning the exposed patch to record a set-up toner density patch;

means for detecting the density of the recorded set-up toner density patch; and means for adjusting the exposure value of said second light source in accordance with differences between the density of the recorded patch and a corresponding aim value.

2. An electrophotographic copier adapted to use a first light source to copy reflection originals and to use a second light source to copy transparency originals; said copier comprising:

a photoconductive image receiver;

calibration means for adjusting operation of the copier to attain a desirable copy image of reflection originals using the first light source;

means for generating a toner density aim value corresponding to the adjusted operation of the copier attained by said calibration means;

means associated with said second light source for exposing a patch on the image receiver through a test transparency of predetermined optical density;

development means for toning the exposed patch to record a set-up toner density patch;

means for detecting the density of the recorded set-up toner density patch; and means for adjusting the exposure value of said second light source in accordance with differences between the density of the recorded patch and said toner density aim value.

3. A process for adjusting the exposure value of an electrophotographic copier adapted to use a first light source to copy reflection originals and to use a second light source to copy transparency originals; said process comprising the steps of:

adjusting operation of the copier to attain a desirable copy image of reflection originals using the first light source;

exposing a patch through a test transparency of predetermined optical density;

toning the exposed patch to record a set-up toner density patch;

detecting the density of the recorded set-up toner density patch; and adjusting the exposure value of said second light source in accordance with differences between the density of the recorded patch and a corresponding aim value.

4. A process for adjusting the exposure value of an electrophotographic copier adapted to use a first light source to copy reflection originals and to use a second light source to copy transparency originals; said process comprising the steps of:

adjusting operation of the copier to attain a desirable copy image of reflection originals using the first light source;

generating a toner density aim value corresponding to the adjusted operation of the copier attained by said calibration means;

exposing a patch on the image receiver through a test transparency of predetermined optical density;

toning the exposed patch to record a set-up toner density patch;

detecting the density of the recorded set-up toner density patch; and adjusting the exposure value of said second light source in accordance with differences between the density of the recorded patch and said toner density aim value.

* * * * *